US011391425B2

(12) United States Patent
Dahan et al.

(10) Patent No.: US 11,391,425 B2
(45) Date of Patent: Jul. 19, 2022

(54) SOLAR STRING LIGHT

(71) Applicant: LES PRODUITS SUNFORCE INC., Montreal-Ouest (CA)

(72) Inventors: Michael Dahan, Hampstead (CA); Bo Tan, Guangzhou (CN)

(73) Assignee: LES PRODUITS SUNFORCE INC., Montréal-Ouest (CA)

( * ) Notice: Subject to any disclaimer, the term of this patent is extended or adjusted under 35 U.S.C. 154(b) by 0 days.

(21) Appl. No.: 17/535,644

(22) Filed: Nov. 25, 2021

(65) Prior Publication Data

US 2022/0163175 A1 May 26, 2022

Related U.S. Application Data

(60) Provisional application No. 63/118,670, filed on Nov. 26, 2020.

(51) Int. Cl.

| | |
|---|---|
| ***F21S 9/03*** | (2006.01) |
| ***F21S 4/10*** | (2016.01) |
| ***F21V 31/00*** | (2006.01) |
| ***F21V 23/06*** | (2006.01) |
| *F21Y 115/10* | (2016.01) |

(52) U.S. Cl.

CPC ..... *F21S 9/032* (2013.01); *F21S 4/10* (2016.01); *F21V 23/06* (2013.01); *F21V 31/005* (2013.01); *F21Y 2115/10* (2016.08)

(58) Field of Classification Search

CPC ..... F21S 9/032; F21S 4/10; F21V 31/005; F21Y 2115/10

See application file for complete search history.

(56) References Cited

FOREIGN PATENT DOCUMENTS

| | | | | | |
|---|---|---|---|---|---|
| CN | 2672449 | Y | | 1/2005 | |
| CN | 101680613 | A | * | 3/2010 | ..... F21K 9/135 |
| CN | 203464146 | U | | 3/2014 | |
| CN | 102384376 | B | * | 5/2014 | ..... F21K 9/23 |
| CN | 204785774 | U | | 11/2015 | |
| KR | 20200077188 | A | * | 2/2020 | |

OTHER PUBLICATIONS

Luci Solar String Lights—MPOWERD Inc. https://mpowerd.com/products/string-lights.

LE Solar Outdoor String Lights https://www.amazon.ca/Outdoor-Waterproof-Christmas-Festival-Decoration/dp/B07Y1SV72F/ref=asc_df_B07Y1SV72F/?tag=googleshopc0c-208linkCode=df0&hvadid=3355425138208hvpos=&hvnetw=g&hvrand=2676756923979804751&hvpone=&hvptwo=&hvqmt=&hvdev=c&hvdvcmdl=&hvlocint=&hvlocphy=9000528&hvtargid=pla-845334660160&psc=1.

Strings S14 Solar String Light Outdoor https://www.dhgate.com/product/strings-S14-solar-string-light-outdoor-48f/712015718.html?f=bm%7cGMC%7cpla%7c14579026724%7c126622316373%7c712015718%7cpla-320467456714%7c117003010%7cUS%7canywong%7cc%7c2%7c&utm_source=pla&utm_medium=GMC&utm_campaign=anywong&utm_term=712015718&gclid=CjwKCAjw7rWKBhAtEiwAJ3CWLl779LYcbiZBGMP1StqOfyblFc6rE24KA55PvqtErMwL7i9U5lrzXRoCKk4QAvD_BwE.

* cited by examiner

*Primary Examiner* — Anabel Ton

(74) *Attorney, Agent, or Firm* — Benoit & Cote Inc.; Charles-Andre Caron

(57) ABSTRACT

A weather-resistant socket assembly is adapted to be used with a string light. The weather-resistant socket assembly for a string light, comprises an electrically powered housing having an opening, a chamber extending from the opening, and a ridged wall covering a portion of an internal periphery of the electrically powered housing; and a socket comprising electrical connections adapted to power the socket and a cooperating ridged wall covering a portion of an external periphery of the socket. When the socket is inserted in the (Continued)

chamber of the electrically powered housing, the ridged wall and the cooperating ridged wall come into contact and the contact prevents a rotation of the socket relative to the electrically powered housing. Further described is a solar string light that comprises the weather-resistant socket assembly.

20 Claims, 13 Drawing Sheets

SOLAR STRING LIGHT

CROSS-REFERENCE TO RELATED APPLICATION

This application claims priority from U.S. provisional patent application 63/118,670 filed Nov. 26, 2020, the specification of which is hereby incorporated herein by reference in its entirety.

BACKGROUND

(a) Field

The subject matter disclosed generally relates to lighting and more particularly exterior lighting. More particularly, the subject matter disclosed relates to exterior lighting powered by solar panels and components thereof.

(b) Related Prior Art

In the field of exterior lighting, lighting is an integral part of the ambiance. However, connection to the grid is not always easy to reach, and sometimes involves lengthy power cords extending all over the place.

In response to these constraints, individual solar-powered lighting devices have been developed, such as the SOLAR POWERED LIGHT ASSEMBLY TO PRODUCE LIGHT OF VARYING COLORS, US Patent Publication No. 2020/0029409 A1 by Richmond that describes individual devices that comprise a spike to put the device in the ground.

Nevertheless, the lighting devices of Richmond comprises numerous drawbacks, comprising a lack of synchronicity at the power-on time between multiple lighting devices, the limitation in the location of the lighting devices spiked in the ground, and limitations on the capacity to replace the lighting components without having to replace the entire lighting device.

Furthermore, solar strings are designed to resist to weather conditions such as wind, rain and direct sun that may generate premature wear when the design of the string light is not robust enough to resist to these weather conditions in a repetitive manner.

There is therefore a need for improvement in the field of solar-powered lighting devices that respond to these drawbacks.

SUMMARY

According to an embodiment, there is provided a weather-resistant socket assembly for a string light, comprising: an electrically powered housing having an opening, a chamber extending from the opening, and a ridged wall covering a portion of an internal periphery of the electrically powered housing; and a socket comprising electrical connections adapted to power the socket and a cooperating ridged wall covering a portion of an external periphery of the socket, wherein, when the socket is inserted in the chamber of the electrically powered housing, the ridged wall and the cooperating ridged wall come into contact and the contact prevents a rotation of the socket relative to the electrically powered housing.

According to an aspect, the ridged wall and the cooperating ridged wall have complementary sinusoidal shapes which come into contact to prevent axial movement between the socket and the electrically powered housing.

According to an aspect, the electrically powered housing comprises a ring-shaped channel, the socket comprises an outwardly projecting ring adapted to interface with the ring-shaped channel to further prevent axial movement between the socket and the electrically powered housing.

According to an aspect, the ridged wall of the electrically powered housing is farther from the opening than the ring-shaped channel is from the opening.

According to an aspect, the ridged wall and the cooperating ridged wall have ridges extending parallel to the opening of the electrically powered housing.

According to an aspect, the socket comprises a string-connecting cavity and the socket comprises a fin-shaped portion adapted to come into contact with the string-connecting cavity, wherein the contact further prevents a rotation of the socket relative to the electrically powered housing.

According to an aspect, the electrically powered housing further comprises reinforcements adapted to receive an electrically conductive string, wherein the string-connecting cavity is least partially defined within the reinforcements and the fin-shaped portion is at least partially housed within the reinforcements.

According to an aspect, the socket comprises complementary pieces which together define the socket.

According to an aspect, the socket defines a lighting-component compartment therein, and wherein the complementary pieces comprise connection channels providing paths for electrical connections between the string-connecting cavity and the lighting-component compartment.

According to an embodiment, there is provided a solar string light comprising: a photovoltaic module for generating electrical power; and a string assembly comprising: an electrically conductive string connectable to the photovoltaic module, the electrically conductive string being powered by the photovoltaic module; and a plurality of light modules mechanically mounted and electrically connected to the electrically conductive string over its length, at least one light module comprising a socket assembly comprising: an electrically powered housing having an opening, a chamber extending from the opening, and a ridged wall covering a portion of an internal periphery of the electrically powered housing; and a socket comprising electrical connections adapted to power the socket and a cooperating ridged wall covering a portion of an external periphery of the socket, wherein, when the socket is inserted in the chamber of the electrically powered housing, the ridged wall and the cooperating ridged wall come into contact and the contact prevents a rotation of the socket relative to the electrically powered housing.

According to an aspect, the solar string light further comprises a releasable lighting component adapted to be plugged into the socket assembly, wherein the lighting component is a LED for producing light of different colors.

According to an aspect, the solar string light further comprises a remote control for wirelessly transmitting commands to a transducer for controlling the light modules.

According to an aspect, the light modules operate in a coordinated manner.

According to an embodiment, there is provided a socket assembly for a string light, comprising: an electrically powered housing having an opening, a chamber extending from the opening, and a ring-shaped channel in the chamber; and a socket comprising electrical connections adapted to power the socket and an outwardly projecting ring adapted to interface with a ring-shaped channel, wherein, when the socket is inserted in the chamber of the electrically powered housing, the ring-shaped channel and the outwardly projecting ring come into contact and the contact prevents an axial movement of the socket relative to the electrically powered housing.

According to an aspect, the electrically powered housing further comprises a string-connecting cavity, and the socket further comprises a fin-shaped portion adapted to interface with the string-connecting cavity to prevent a rotation of the socket relative to the electrically powered housing.

According to an aspect, the electrically powered housing further comprises reinforcements adapted to receive an electrically conductive string, wherein the string-connecting cavity is adapted to be at least partially inserted in the reinforcements.

According to an aspect, the electrically powered housing further comprises a ridged wall covering a portion of an internal periphery of the electrically powered housing, and the socket further comprises a cooperating ridged wall covering a portion of an external periphery of the socket to further prevent axial and rotational movement of the socket relative to the electrically powered housing.

According to an aspect, the ridged wall and the cooperating ridged wall have complementary sinusoidal shapes, the ridged wall and the cooperating ridged wall extend parallel to the opening of the electrically powered housing and come into contact to prevent axial movement between the socket and the electrically powered housing.

According to an aspect, the ridged wall of the electrically powered housing is farther from the opening than the ring-shaped channel is from the opening.

According to an aspect, the socket comprises complementary pieces which together define the socket, wherein the socket defines a lighting-component compartment therein, and wherein the complementary pieces comprise connection channels providing paths for electrical connections to travel between the string-connecting cavity and the lighting-component compartment when the electrical connections are inserted in the electrically powered housing.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
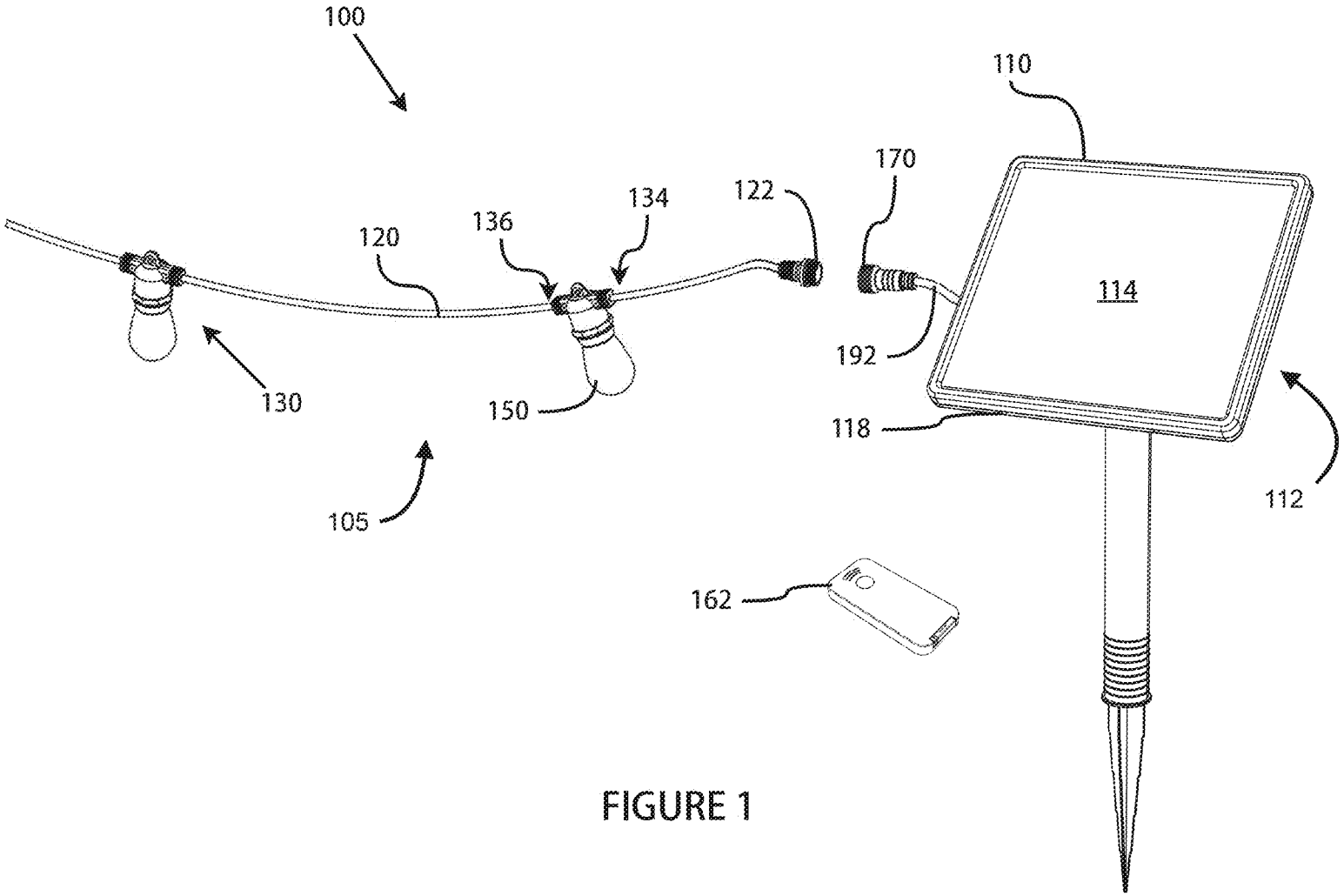
FIG. 1 is a perspective view of a portion of a solar string light in accordance with an embodiment.
Figure 3:
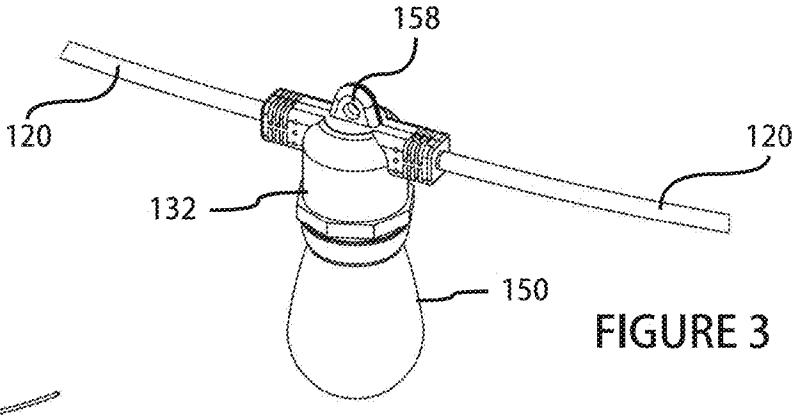
FIG. 3 is a close-up perspective view depicting a portion of the string with a single lighting module mounted thereto.
Figure 4:
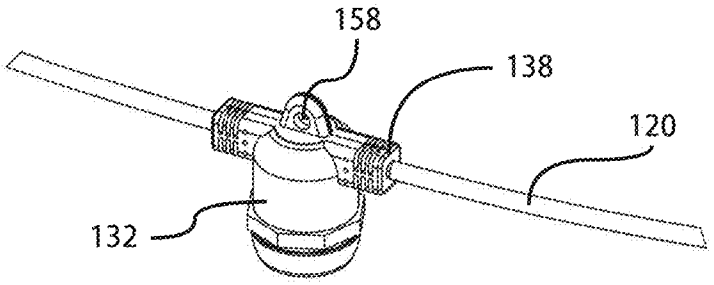
FIG. 4 is the close-up perspective view of the components of FIG. 3 with the lighting component dismounted from the lighting modules.
Figure 2:
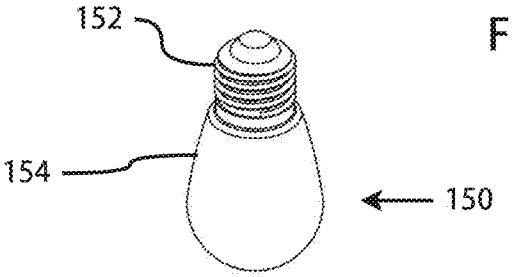
FIG. 2 is a perspective view of a string with lighting modules mounted thereto of the solar string light of FIG. 1.
Figure 2:
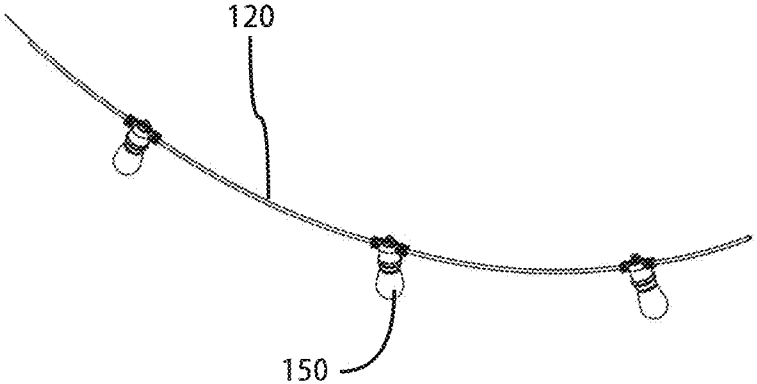
Figure 5:
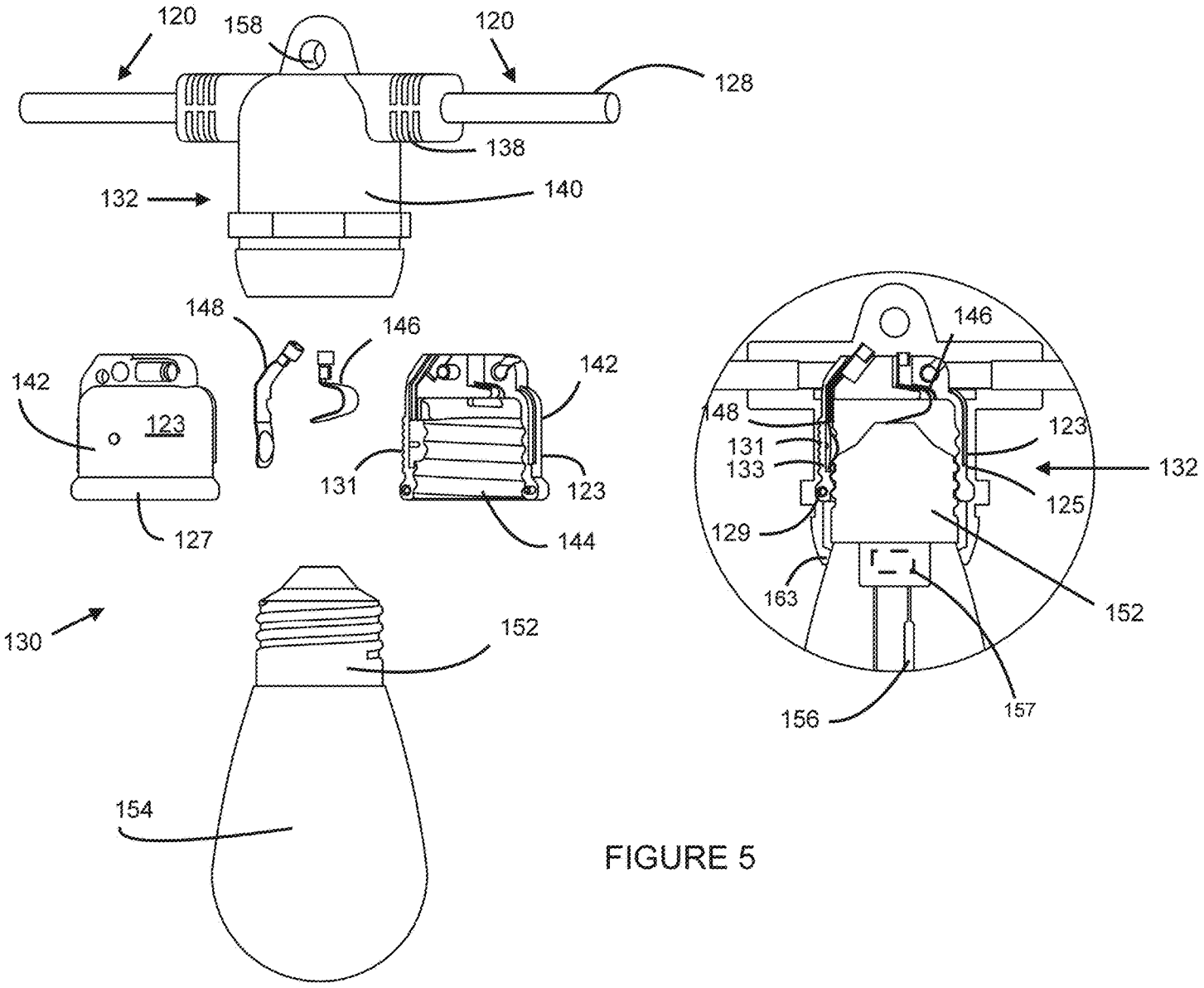
FIG. 5 is an exploded perspective view of the components of FIG. 4.

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

The terms "top", "up", "upper", "bottom", "lower", "down", "vertical", "horizontal", "interior" and "exterior" and the like are intended to be construed in their normal meaning in relation with normal installation of the product.

It should further be noted that for purposes of this disclosure, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members, or the two members and any additional intermediate members, being integrally formed as a single unitary body with one another or with the two members or the two members and any additional intermediate members being attached to one another. Such joining may be permanent in nature or alternatively may be removable or releasable in nature.

In realizations, there is disclosed a solar string light 100 designed to be installed outdoors, but which may also be installed indoors.

It will be noted that throughout the appended drawings, like features are identified by like reference numerals.

Referring now to the drawings, and more particularly to FIG. 1, the solar string light 100 comprises a photovoltaic module 110 enclosing a battery (not shown), a mounting module 112 adapted to mount the photovoltaic module 110 at a selected location, and a string assembly 105 comprising an electrically conductive electrical string 120 connected to the photovoltaic module 110 and several lighting modules 130 mounted to the electrical string 120.

Referring additionally to FIGS. 2 to 5, the electrical string 120 comprises one extremity adapted to connect to the photovoltaic module 110, wherein the connection between the photovoltaic module 110 and the electrical string 120 is performed according to a plug and socket connection.

In the depicted realization, the photovoltaic module 110 features a socket 170 while the electrical string 120 features a plug 122 connectable to the socket 170 to thereby create an electric circuit.

The electrical string 120 comprises at least a pair of wires (not shown) extending in a sleeve 128, wherein the sleeve 128 is made of polymer-type material enclosing the wires and isolating the wires from the environment.

The combination of the sleeve 128 and the wires defines a flexible string that may be bent, curled, or otherwise shaped to a certain limit to marry a desired shape to follow, for example, the surface of a structure.

The combination of the sleeve 128 and the wires further provides the tension resistance necessary for the electrical string 120 to hang the string between two structures over a substantial distance, for example 2 meters, without the tension in the electrical string 120 affecting the capacity of the electrical string 120 to conduct power. Accordingly, the assembly of the housing 132 with the sleeve 128 operates as a strain relief.

Still referring to FIGS. 1 to 5, the solar string light 100 comprises several lighting modules 130 mounted, typically, equidistantly on the electrical string 120. Each of the lighting module 130 comprises a housing 132 attached to the electrical string 120.

Typically, the intermediary lighting modules 130 comprise an inlet 134 and an outlet 136, wherein the inlet 134 is connected to the portion of the electrical string 120 in the direction of the photovoltaic module 110 and the outlet 136 is connected to the portion of the electrical string 120 extending away from the photovoltaic module 110.

The inlet 134 and the outlet 136 feature reinforcements 138 extending from the central portion of the housing 132 over the exterior face of the sleeve 128, wherein fixation of the reinforcements 138 over the sleeve 128 prevents a tension over the sleeve 128 opposed to the central portion of the housing 132 to result in the sleeve 128 being pulled out of the housing 132.

The housing 132 features an exterior face 140 made of polymer-type material that, according to a preferred realization, is similar to the polymer-type material of the sleeve 128, whereby the combination of the electrical string 120 and the lighting modules 130 provides a consistent surface.

According to a realization, the entire housing 132 is made of polymer-type material isolating the content of the housing 132 from the environment and protecting the content of the housing 132 from weather conditions.

According to realizations, the housing 132 features fixing means 158 such as a hook, a ring (as depicted), or a carabiner, wherein the fixing means provides aid for mounting the electrical string 120 to a structure or for hanging the electrical string 120 from structures.

Referring now particularly to FIG. 5 and FIGS. 18 to 20, the housing has an opening 135 and a string-connecting cavity 160 distal from the opening 135, with the string-connecting cavity 160 being located near the attachment between the electrical string 120 and the housing 132. A generally cylindrical chamber 137 extends therein between the opening 135 and the string-connecting cavity 160.

The housing 132 encloses a socket 142 composed of two complementary pieces 165*a*, 165*b* fitting together and guiding and holding electrical connections 146, 148 through connection channels 169*a*, 169*b*. The socket 142 features threads 144 in the interior surface of its lighting-component compartment 167 adapted to cooperate with the threaded metallic base 152 of the lighting component 150. The bottom electrical connection 146 is adapted to contact the foot portion 166 of the threaded metallic base 152 while the side electrical connection 148 is adapted to contact the periphery portion 164 of the threaded metallic base 152 about the start of the threaded portion, wherein the foot portion 166 and the periphery portion 164 are electrically insulated from each other and are the connecting poles of the LED components 156.

According to a realization, the contact portions of the electrical connections 146 and 148, adapted to electrically connect the lighting component 150, are respectively biased toward the opening 135 of the housing 132 and toward the center of a cylindrical chamber 137 extending from the opening 135 to the string-connecting cavity 160 the housing 132, with the screwing of the lighting component 150 in the housing 132 resulting in the lighting component 150 abutting and compressing the contact portion of the electrical connections 146 and 148, thereby ensuring that the electrical contacts between the contact portions of the electrical connections 146 and 148 and the lighting component 150 are optimal.

It is to be noted that even though the figures do not depict explicitly the powering of the electrical connections 146, 148, extremities or portions of the electrical connections 146, 148 distant from the socket 142 are electrically connected to the electric wires housed in the sleeve 128 to be powered thereby powering the housing 132 (aka the electrically powered housing 132).

The socket 142 has a generally fin-shaped portion 161, i.e., a narrow projection extending from the main body, at its connecting extremity that eases the alignment of the socket 142 with the electrical string 120. The fin-shaped portion 161 allows to have the reinforcements 138 housing the whole string-connecting cavity 160 within the reinforcements 138.

The socket 142 further features a cylindrical exterior face 123 adapted to fit in a corresponding interior cylindrical face 125 of the housing 132. The socket 142 has, about its opening, an outwardly projecting ring 127 adapted to be housed within a ring-shaped channel 129 when inserted in the housing 132.

Cooperating ridged walls 131 and 133 having, according to a realization, ridges 145 of a sinusoidal shape parallel to the opening 135, further provide an interface 139 between the socket 142 and the housing 132 for participating in ensuring that the socket 142, once inserted in the housing 132, will not exit the housing 132 under weather conditions or when inserting or removing, i.e., screwing or unscrewing, a lighting component 150 from the socket 142. The interface 139 preferably extends over less than the whole periphery of the chamber 137.

According to an embodiment, the cooperating ridged walls 131 and 133 cover a specific portion of the interface at external periphery of the socket 142 and the internal periphery of the housing 132. Thus, the cooperating ridged walls 131 and 133 also provide resistance against rotation of the socket 142 into the housing 132.

Furthermore, the interface 139 formed by the ridged walls 131, 133 and the interface 141 between the projecting ring 127 and the circular channel 129 provide resistance against axial displacement of the socket 142 relative to the housing 132. The interface 139 between the ridged walls 131, 133 and the interface 143 between the fin-shaped portion 161 and the string-connecting cavity 160 within the reinforcements 138 provide resistance against rotation of the socket 142 into the housing 132. The interface 141 between the projecting ring 127 and the circular channel 129 furthermore ensures that the electric components, e.g., electrical connections 146, 148, are kept in a waterproof chamber as long as the reinforcements 138 ensures waterproofing at the string extremity.

According to a realization, housing 132 further comprises a skirt 163 at the opening 135. The contact between the skirt 163 and the enclosure 154 of the lighting component 150, upon fully screwing in the lighting component 150 in the socket 142, further acts to seal the chamber 137 against the external elements.

Referring back to FIGS. 1 to 5, the lighting modules 130 comprises a lighting component 150 comprising a threaded metallic base 152, an enclosure 154, and LED components 156, aka LED lighting component, located in the enclosure 154.

According to realizations, the enclosure 154 may take various shapes, may be made of translucent material, or clear solid material.

According to realizations, shades (not depicted) and other light-reflecting or light-diffusing components may be mounted to the housing 132 and extending aside and/or away from the enclosure 154 to modify the light ambiance provided by the solar string light 100.

According to a realization, the LED components 156 consists of a multi-color LED lighting allowing the color of the light generated by the photovoltaic module 110 to be controlled, changed, and/or programmed to follow a pattern to provide particular lighting ambiances.

According to a realization, the LED components 156 comprises a transducer 157 that communicates with a remote control 162 transmitting commands wirelessly to the LED components 156, for example to operate in a specific color or to operate according to a preset pattern.

The LED components 156 may further receive the same command from the remote control 162, allowing them to operate in a coordinate manner, for instance producing light of the same color, being turned on and off in a synchronous manner, and operating the same pattern of light colors synchronously for example.

According to a realization (not depicted), the solar string light 100 comprises a last lighting module 130 including an inlet 134 but having no outlet. The sockets 142 of all of the lighting modules 130 are connected to both wires therein and are thus connected in parallel.

According to a realization (not depicted), the solar string light 100 comprises a last lighting module 130 including both an inlet 134 and an outlet 136. The electrical string 120 extending downward from the outlet 136 ends with a socket wherein an extension string may be connected to a first electrical string 120 and thus electrically connected to the photovoltaic module 110. According to realizations, the number of extension strings is limited by the characteristics of the photovoltaic module 110, the electric requirements of each of the strings 120, and the electric capacity of the electric conductors (wires, plugs and sockets). According to these realizations, a closing plug is provided to close off a socket not connected to another electrical string 120 from weather conditions.

Referring now to FIGS. 1 and 7 to 17, the solar string light 100 comprises a photovoltaic module 110 comprising a casing 118 defining an enclosure in which is mounted a photovoltaic cell 114 and a micro-inverter (not shown) powering the battery. The circuit comprising the battery, the photovoltaic cell 114, and the micro-inverter is further connected to a socket 170 out of the casing 118 to be connected to the electrical string 120. According to a preferred realization, the photovoltaic cell 114 is mounted to the front of the photovoltaic module 110, and the socket 170 is mounted to a flexible sleeved cable mounted and electrically connected to the back of the casing 118 and able to extend in any direction.

Figure 11:
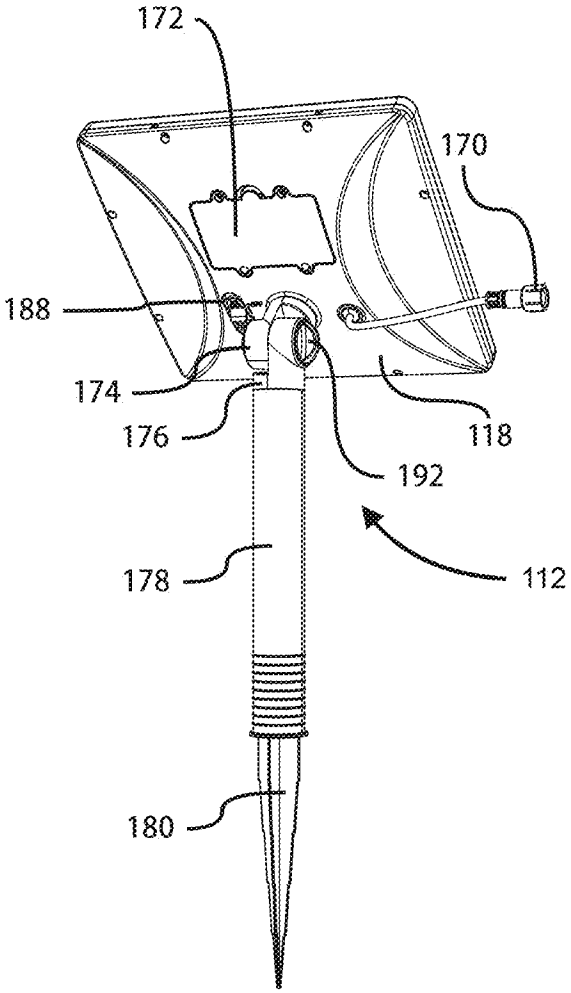
FIGS. 10 and 11 are respectively a front perspective view and a rear perspective view of the assembly of FIG. 8 comprising the photovoltaic module ready to be inserted in the ground.
Figure 10:
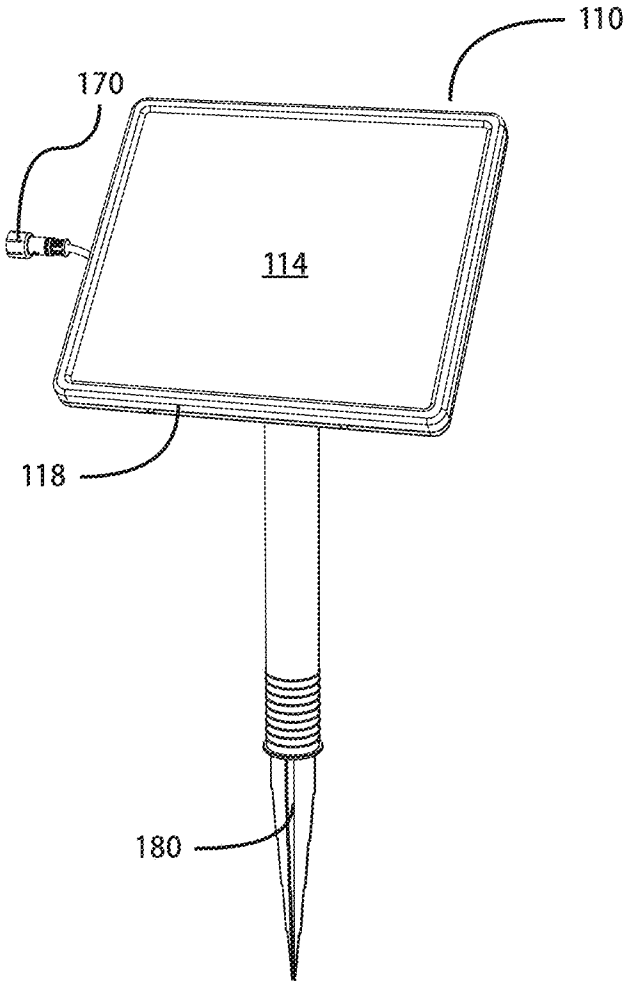

Referring particularly to FIGS. 10 and 11, the casing 118 comprises, at the back, a removable door 172 providing access to the battery. The photovoltaic module 110 further comprises a mounting module 112 that comprises a swivel assembly 174 that is attached on one side to the back of the casing 118 and on the other side features a fitting 176 that may be mounted to a mounting means 178.

The swivel assembly 174 allows orienting the photovoltaic cell 114 toward a light source, the sun, to optimize the efficiency of the photovoltaic cell 114. The swivel assembly 174 is particularly adapted to be oriented and to be blocked at a selected orientation. According to realizations, the swivel assembly 174 may feature a lock 192 (e.g., a screw or a pushbutton lock) allowing the swivel assembly 174 to enter in and exit from a lock configuration.

According to a realization depicted in FIGS. 8 to 11, the mounting means 178 comprises a spike 180 that may be inserted in the ground.

Figure 17:
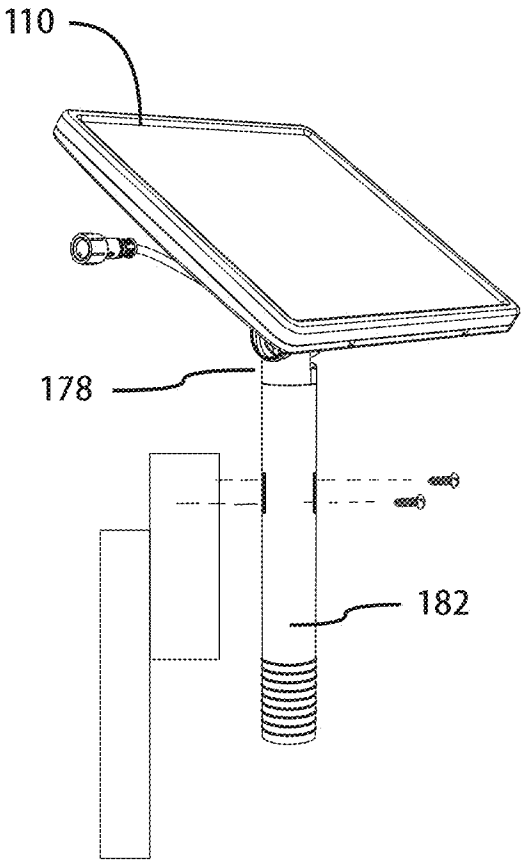
FIGS. 16 and 17 are respectively a front perspective view and a side view of the photovoltaic module of FIG. 1 ready to be mounted to a fence or a railing using screws.
Figure 16:
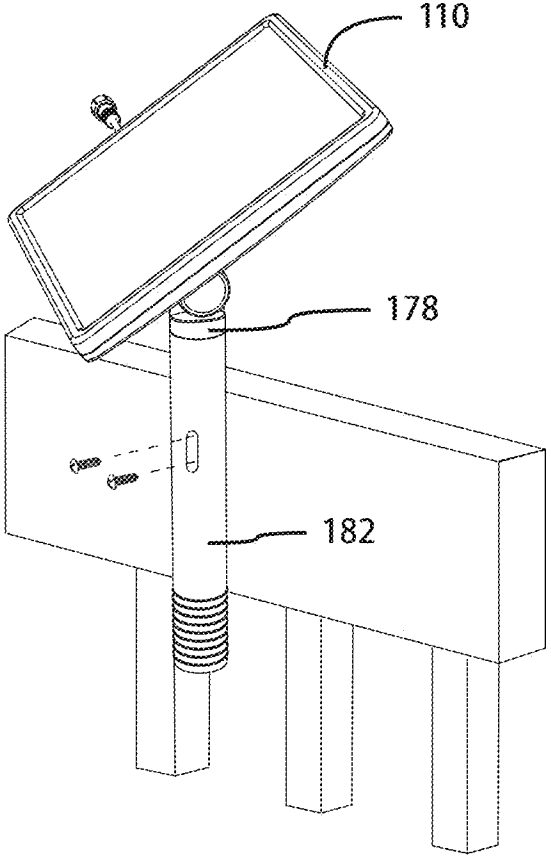
Figure 18:
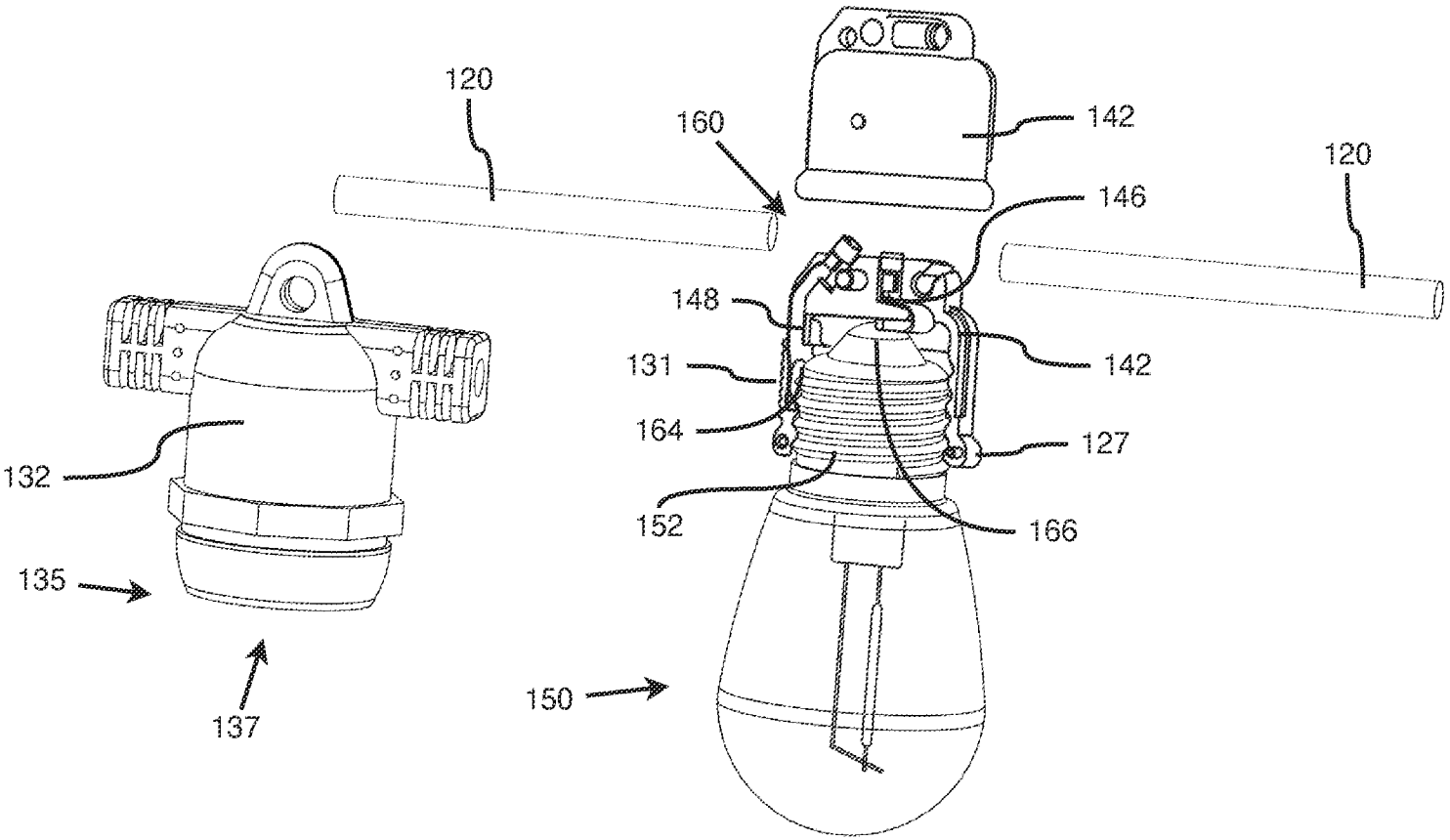
FIG. 18 is an exploded perspective view of a portion of the string with a single lighting module mounted thereto of FIG. 3.
Figure 20:
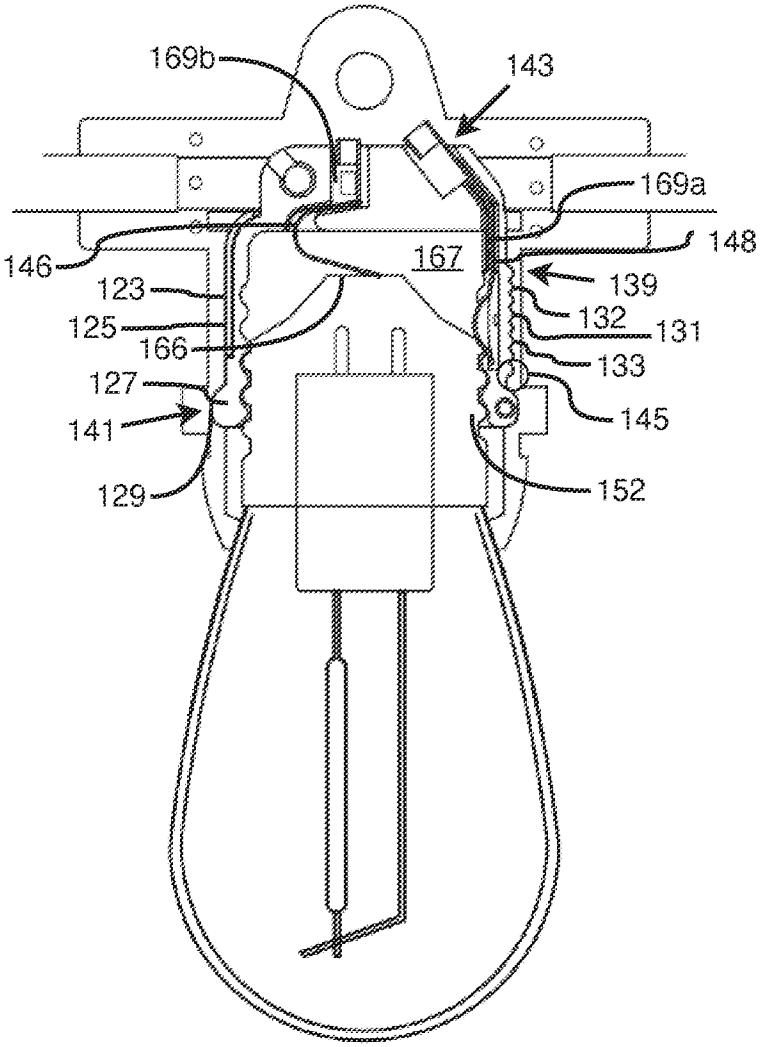
FIG. 20 is a close-up front view of the electrically powered housing with a lighting module mounted thereto.
Figure 19:
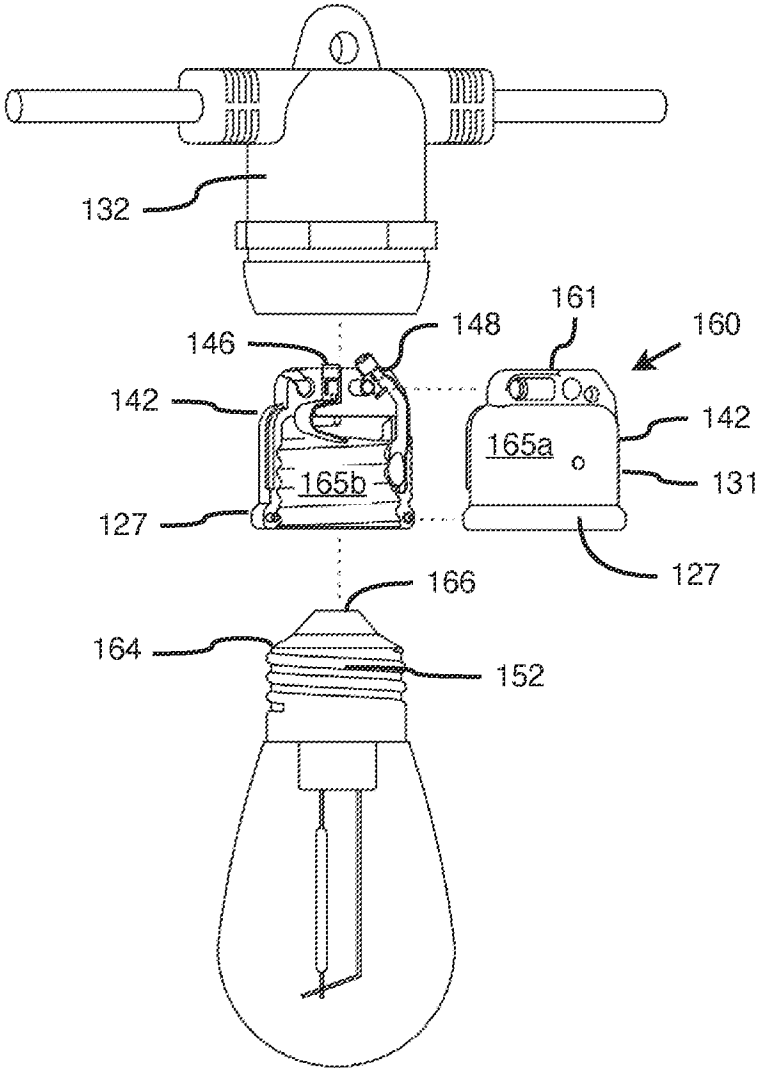
FIG. 19 is a front exploded view of the portion of the string with a single lighting module mounted thereto of FIGS. 3 and 18.

According to a realization depicted in FIGS. 16 and 17, the mounting means 178 is a pole 182, or another type of fitting that may be attached to a structure.

According to a realization depicted in FIGS. 12 to 15, regarding the mounting module 112, the mounting means 178 is designed to be mounted to a jaw assembly 184 itself adapted to be mounted to a structure without the use of structure penetrating screws or other fixing means that may contact and damage the structure.

Figure 7:
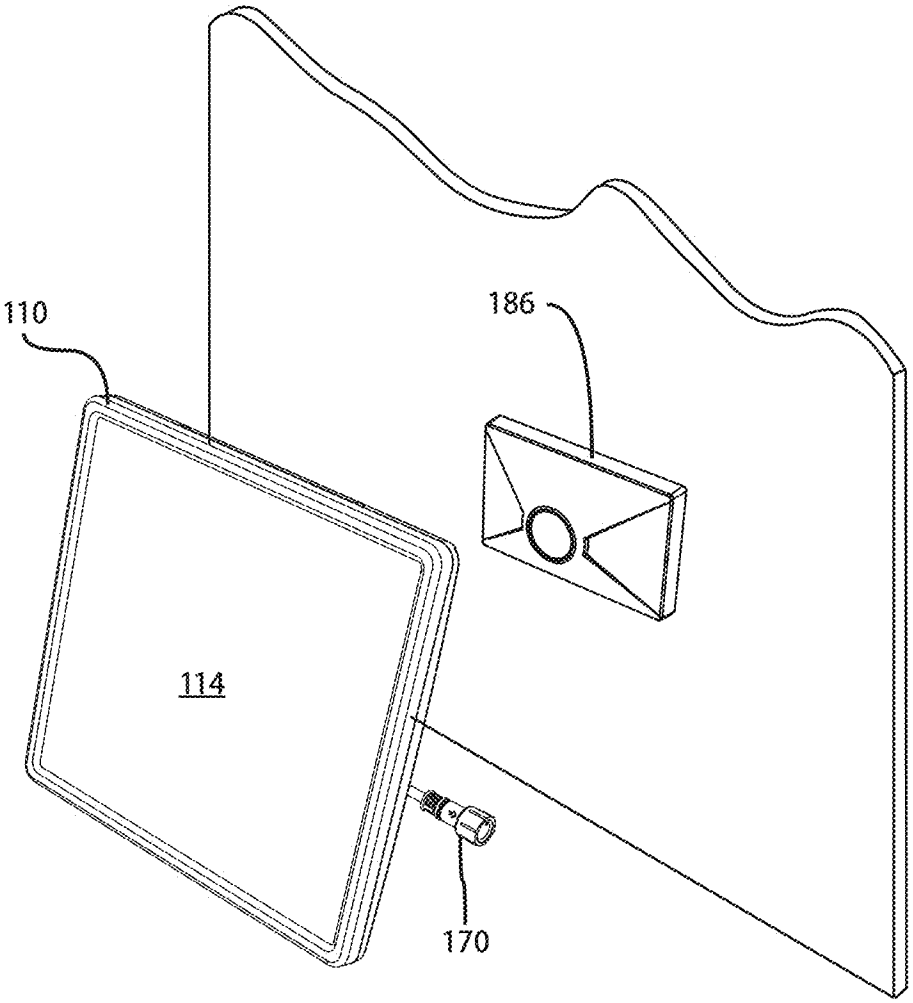
FIG. 7 is a perspective view of the photovoltaic module of FIG. 6 ready to be mounted to a fitting mounted to the wall.
Figure 6:
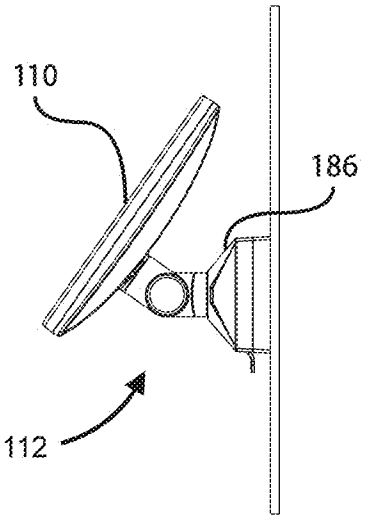
FIG. 6 is a side view of the photovoltaic module of FIG. 1 mounted to a wall.
Figure 9:
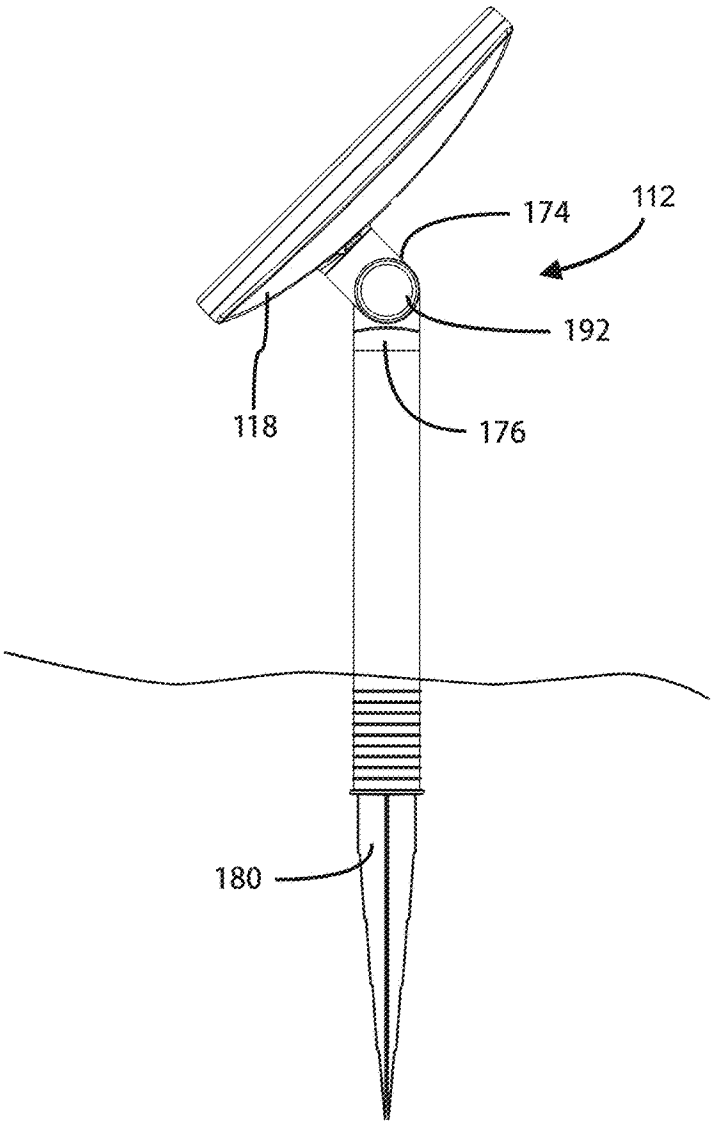
FIGS. 8 and 9 are respectively a front view and a side view of the photovoltaic module of FIG. 1 mounted to a spike inserted in the ground.
Figure 8:
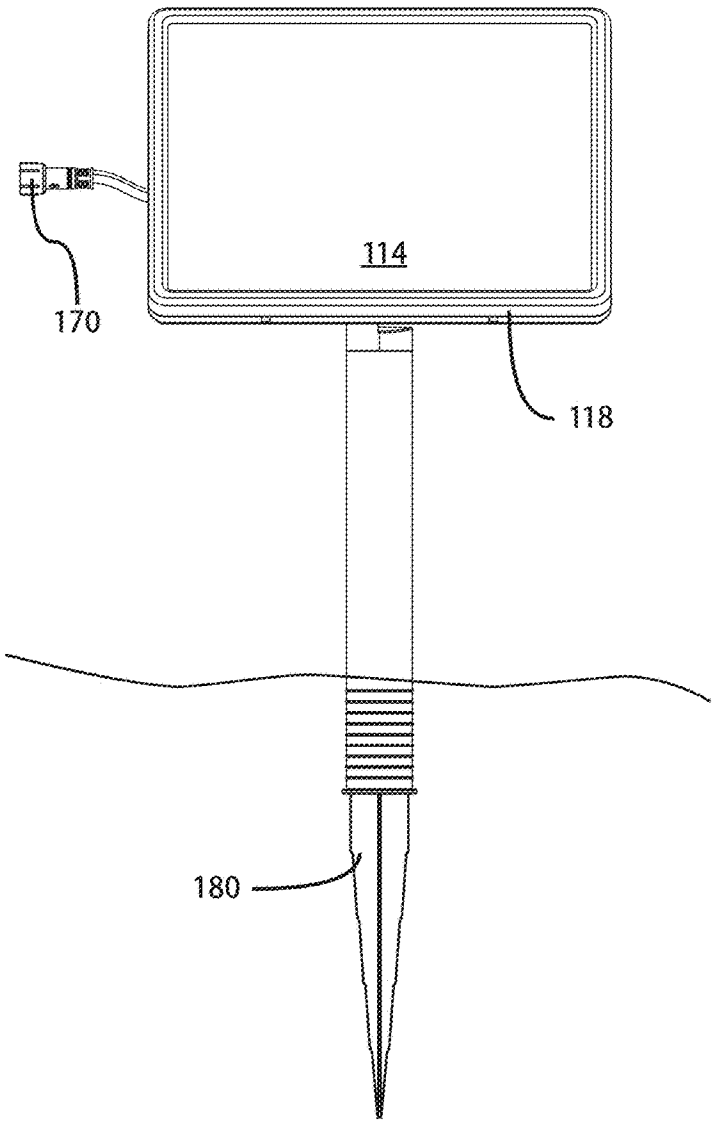

According to a realization depicted on FIGS. 6 and 7, the mounting module 112 is designed to mount the photovoltaic module 110 to a wall using a support 186, e.g., a wall support 186, but alternatively the mounting module 112 could be adapted for mounting the photovoltaic module 110 to a ceiling or a floor, or to be affixed to a support structure, e.g., a wall, a ceiling, a floor.

According to a realization, the fitting 176 is adapted to be mounted to any one of a spike 180, a pole 182, a jaw assembly 184, and a support 186 based on the available mounting opportunity.

Figure 12:
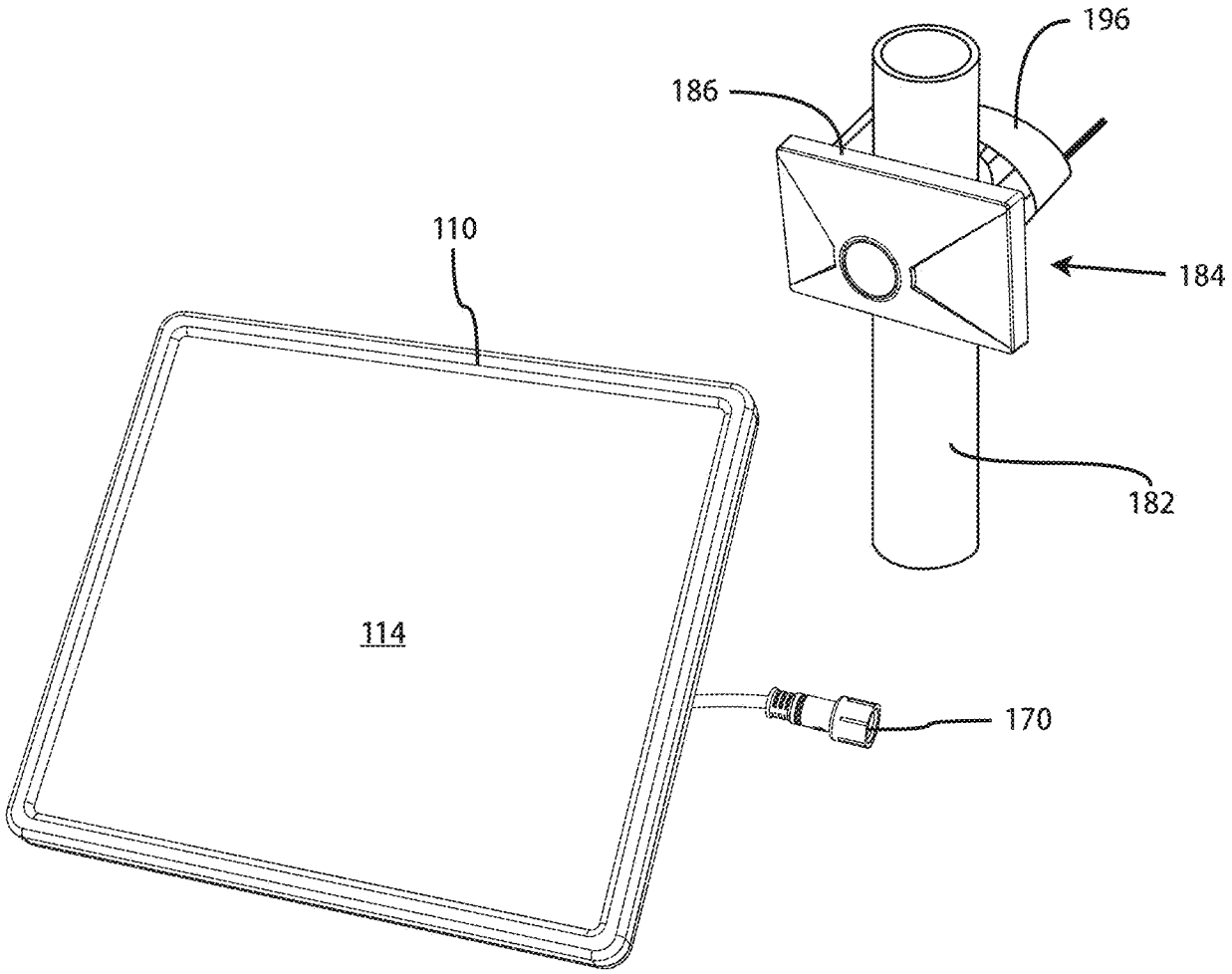
FIGS. 12 and 13 are respectively a front perspective view and a rear perspective view of the photovoltaic module of FIG. 1 ready to be mounted to a jaw assembly mounted to a pole or a post.
Figure 13:
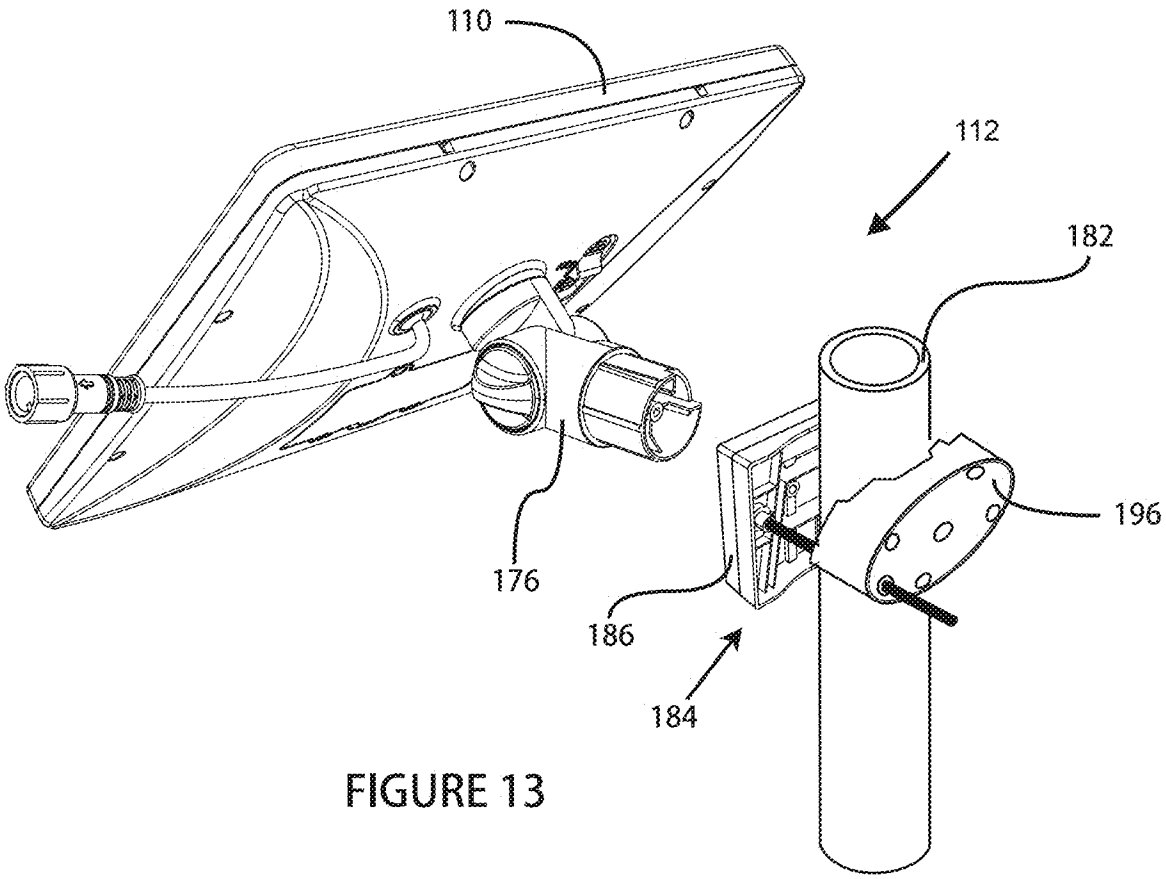

According to a realization depicted in FIGS. 12 and 13, the wall support 186 is a component of the jaw assembly 184 combinable with a second component 196 of the jaw assembly 184 and attached to one another using a set of fixations passing through a portion of the wall support 186, wherein the same features, e.g., holes, of the portion of the support 186 is adapted to have screws passing therethrough to be fixed to a structure as an autonomous support 186.

Figure 14:
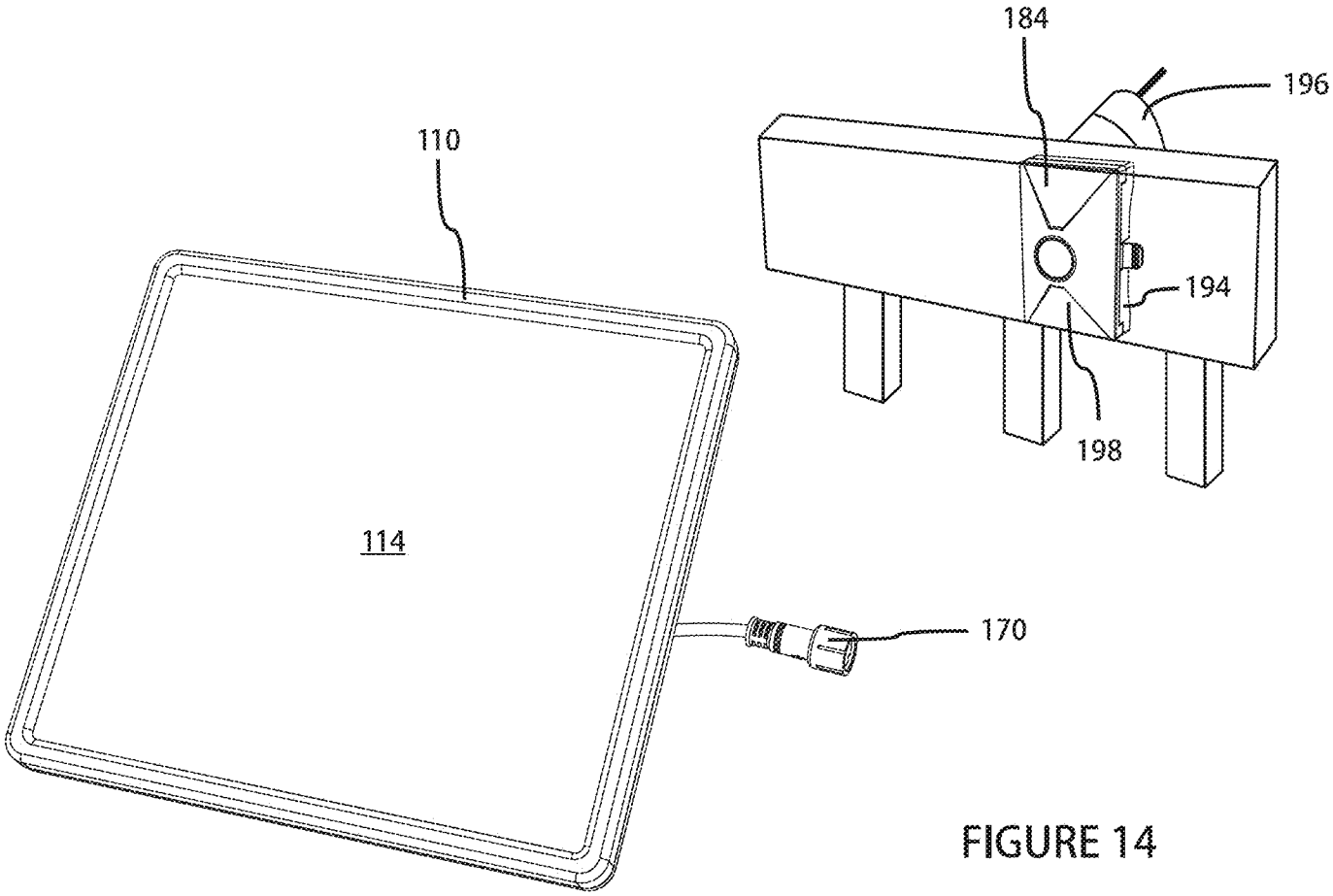
FIGS. 14 and 15 are respectively a front perspective view and a rear perspective view of the photovoltaic module of FIG. 1 ready to be mounted to a jaw assembly mounted to a fence or a railing.
Figure 15:
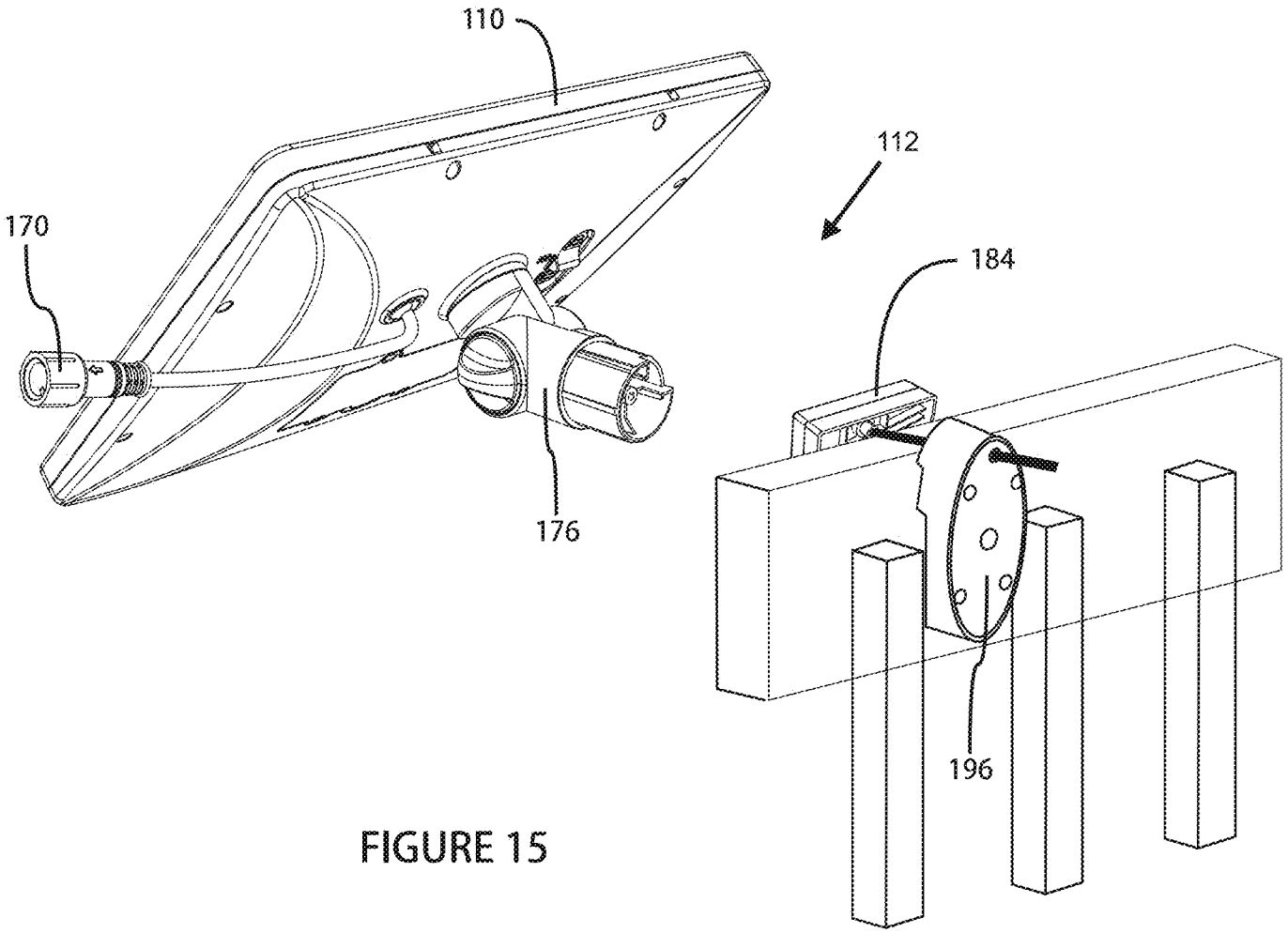

According to a realization depicted in FIG. 14, the support 186 comprises a base 194 and a cap 198, wherein the cap 198 is releasably mountable to the base 194 fixed to a structure using screws or mounted to a second component 196 of the jaw assembly 184 as depicted.

Referring particularly to FIG. 11, the photovoltaic module 110 further comprises a power switch 188 allowing to select if the photovoltaic module 110 is in charging mode or in lighting mode. The charging mode is a mode wherein the micro-inverter feeds only the battery, charging the battery up to its maximum charge level. The lighting mode is a mode wherein the micro-inverter distributes power generated by the photovoltaic cell 114 to both the battery and the electrical string 120 based on respective demands. For instance, in lighting mode, the photovoltaic cell 114 may power only the battery when the LED components 156 are off, and both the battery and the string, or with the help of the battery powering the electrical string 120 based on the power generated by the photovoltaic cell 114 and the power requirement of the electrical string 120.

According to a realization, the micro-inverter may be connected to a power control module (not depicted) and, based on the power generated by photovoltaic cell 114 resulting from the current lighting of the photovoltaic cell 114, the micro-inverter may prevent power to be communicated to the electrical string 120 if the level of power generated is over a threshold value (that corresponds to daytime lighting). In that situation, the LED components 156 can only be powered when no daylight is present, thus only between dusk and dawn.

According to a realization, the photovoltaic module 110 may be remotely powered using the remote control 162.

According to a realization, the power switch 188 is a three-position power switch corresponding to a) charging mode, b) auto/light mode, and c) lighting mode. The auto-light mode is a mode wherein depending on the lighting condition in which the photovoltaic module 110 accepts commands from the remote control 162, the LED components 156 may be remotely controlled to enter in a test mode wherein the LED components 156 may be powered during the daytime.

It is to be noted that the solar string light 100 has the advantage of featuring a central control powering synchronously all of the LED components 156 that are part of the solar string light 100.

The solar string light 100 further has the advantage of controlling the operation of all of the LED components 156 synchronously through a single command entered through the remote control 162.

The solar string light 100 further has the advantage of allowing to position the photovoltaic module 110 at an optimal location regardless of the locations where the lighting components 150 are individually installed.

The solar string light 100 has a further advantage of providing the option to custom the lighting ambiance to be provided through the solar string light 100 via the colors of the light emitted and through the selection of a particular enclosure 154 or the customization of the enclosure 154 with shades or alike.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A weather-resistant socket assembly for a string light, comprising:

an electrically powered housing having an opening, a chamber extending from the opening, and a ridged wall covering a portion of an internal periphery of the electrically powered housing; and a socket comprising electrical connections adapted to power the socket and a cooperating ridged wall covering a portion of an external periphery of the socket, wherein, when the socket is inserted in the chamber of the electrically powered housing, the ridged wall and the cooperating ridged wall come into contact and the contact prevents a rotation of the socket relative to the electrically powered housing.

2. The socket assembly of claim 1, wherein the ridged wall and the cooperating ridged wall have complementary sinusoidal shapes which come into contact to prevent axial movement between the socket and the electrically powered housing.

3. The socket assembly of claim 2, wherein the electrically powered housing comprises a ring-shaped channel, the socket comprises an outwardly projecting ring adapted to interface with the ring-shaped channel to further prevent axial movement between the socket and the electrically powered housing.

4. The socket assembly of claim 3, wherein the ridged wall of the electrically powered housing is farther from the opening than the ring-shaped channel is from the opening.

5. The socket assembly of claim 1, wherein the ridged wall and the cooperating ridged wall have ridges extending parallel to the opening of the electrically powered housing.

6. The socket assembly of claim 1, wherein the socket comprises a string-connecting cavity and the socket comprises a fin-shaped portion adapted to come into contact with the string-connecting cavity, wherein the contact further prevents a rotation of the socket relative to the electrically powered housing.

7. The socket assembly of claim 6, wherein the electrically powered housing further comprises reinforcements adapted to receive an electrically conductive string, wherein the string-connecting cavity is least partially defined within the reinforcements and the fin-shaped portion is at least partially housed within the reinforcements.

8. The socket assembly of claim 6, wherein the socket comprises complementary pieces which together define the socket.

9. The socket assembly of claim 8, wherein the socket defines a lighting-component compartment therein, and wherein the complementary pieces comprise connection channels providing paths for electrical connections between the string-connecting cavity and the lighting-component compartment.

10. A solar string light comprising:

a photovoltaic module for generating electrical power; and a string assembly comprising:

an electrically conductive string connectable to the photovoltaic module, the electrically conductive string being powered by the photovoltaic module; and a plurality of light modules mechanically mounted and electrically connected to the electrically conductive string over its length, at least one light module comprising a socket assembly comprising:

an electrically powered housing having an opening, a chamber extending from the opening, and a ridged wall covering a portion of an internal periphery of the electrically powered housing; and a socket comprising electrical connections adapted to power the socket and a cooperating ridged wall covering a portion of an external periphery of the socket, wherein, when the socket is inserted in the chamber of the electrically powered housing, the ridged wall and the cooperating ridged wall come into contact and the contact prevents a rotation of the socket relative to the electrically powered housing.

11. The solar string light of claim 10, further comprising a releasable lighting component adapted to be plugged into the socket assembly, wherein the lighting component is a LED for producing light of different colors.

12. The solar string light of claim 11, further comprising a remote control for wirelessly transmitting commands to a transducer for controlling the light modules.

13. The solar string light of claim 12, wherein the light modules operate in a coordinated manner.

14. A socket assembly for a string light, comprising:

an electrically powered housing having an opening, a chamber extending from the opening, and a ring-shaped channel in the chamber; and a socket comprising electrical connections adapted to power the socket and an outwardly projecting ring adapted to interface with the ring-shaped channel, wherein, when the socket is inserted in the chamber of the electrically powered housing, the ring-shaped channel and the outwardly projecting ring come into contact and the contact prevents an axial movement of the socket relative to the electrically powered housing.

15. The socket assembly of claim 14, wherein the electrically powered housing further comprises a string-connecting cavity, and the socket further comprises a fin-shaped portion adapted to interface with the string-connecting cavity to prevent a rotation of the socket relative to the electrically powered housing.

16. The socket assembly of claim 15, wherein the electrically powered housing further comprises reinforcements adapted to receive an electrically conductive string, wherein the string-connecting cavity is adapted to be at least partially inserted in the reinforcements.

17. The socket assembly of claim 14, wherein the electrically powered housing further comprises a ridged wall covering a portion of an internal periphery of the electrically powered housing, and the socket further comprises a cooperating ridged wall covering a portion of an external periphery of the socket to further prevent axial and rotational movement of the socket relative to the electrically powered housing.

18. The socket assembly of claim 17, wherein the ridged wall and the cooperating ridged wall have complementary sinusoidal shapes, the ridged wall and the cooperating ridged wall extend parallel to the opening of the electrically powered housing and come into contact to prevent axial movement between the socket and the electrically powered housing.

19. The socket assembly of claim 17, wherein the ridged wall of the electrically powered housing is farther from the opening than the ring-shaped channel is from the opening.

20. The socket assembly of claim 15, wherein the socket comprises complementary pieces which together define the socket, wherein the socket defines a lighting-component compartment therein, and wherein the complementary pieces comprise connection channels providing paths for electrical connections to travel between the string-connecting cavity and the lighting-component compartment when the electrical connections are inserted in the electrically powered housing.

* * * * *